United States Patent [19]

Malbrunot

[11] 4,095,285

[45] June 13, 1978

[54] DEVICE FOR THE PREPARATION OF COATED PRODUCTS FOR CONSTRUCTION AND MAINTENANCE OF HIGHWAYS

[75] Inventor: Pierre Malbrunot, Saint-Cloud, France

[73] Assignee: Creusot-Loire, Paris, France

[21] Appl. No.: 728,793

[22] Filed: Oct. 1, 1976

[30] Foreign Application Priority Data

Oct. 8, 1975 France ..... 75 30788

[51] Int. Cl.[2] ..... B28C 5/08

[52] U.S. Cl. ..... 366/23; 366/54

[58] Field of Search ..... 259/147, 148, 149, 151, 259/154, 175

[56] References Cited

U.S. PATENT DOCUMENTS

| | | | |
|---|---|---|---|
| 1,096,103 | 5/1914 | Giesler | 259/148 |
| 1,462,904 | 7/1923 | Finley | 259/148 |
| 1,774,649 | 9/1930 | Hepburn | 259/148 |
| 2,188,798 | 1/1940 | Smith | 259/151 |
| 2,282,467 | 5/1942 | Faber | 259/175 |
| 2,924,513 | 2/1960 | Altimier | 259/175 |
| 3,161,927 | 12/1964 | Dietert | 259/154 |
| 3,614,071 | 10/1971 | Barck | 259/147 |
| 3,715,107 | 2/1973 | Paris | 259/148 |
| 3,822,866 | 7/1974 | Daester | 259/149 |
| 3,904,723 | 9/1975 | Prince | 259/147 |
| 3,950,861 | 4/1956 | Weimer | 259/151 |

*Primary Examiner*—Herbert F. Ross

*Attorney, Agent, or Firm*—Haseltine, Lake & Waters

[57] ABSTRACT

A device for the preparation of coated products, particularly, but not exclusively, for the construction and maintenance of highways, from aggregate, finely divided material and a binder, comprising a cylindrical drum having an inlet end and an outlet end and rotatably mounted on a platform so that the inlet end is higher than the outlet end, a mechanism for feeding aggregate and finely divided material to the inlet end of the drum, a burner projecting into the inlet end of the drum, and a fixed chamber at the outlet end of the drum for receiving coated products and for discharge of gases circulating in the drum. The drum comprises three zones including a first zone which receives aggregate and finely divided material from the feeding means and conveys it to a second zone substantially without mixing, the second zone serving for homogenizing the mixture of aggregate and finely divided material and optionally for preheating and predrying the mixture and containing lifting devices for lifting the aggregate and finely divided material, the lifting capability of the devices increasing from the inlet to the outlet end of the second zone, and a third zone for mixing the aggregate and finely divided material mixture with binder and optionally for heating and drying the mixture, the binder being supplied to the inlet of the third zone. The third zone includes lifting devices having a high lifting capability such that the products form a substantially continuous curtain across the drum.

16 Claims, 9 Drawing Figures

DEVICE FOR THE PREPARATION OF COATED PRODUCTS FOR CONSTRUCTION AND MAINTENANCE OF HIGHWAYS

FIELD OF THE INVENTION

The invention relates to a device for the preparation of products particularly but not exclusively employed for the construction and maintenance of highways. The invention is particularly applicable to a device for the hot preparation with reduced dust emission, of bituminous coated products for highway surfacing from aggregate, finely divided granular material or powdery matter and binder.

BACKGROUND

Methods and devices are known for the continuous preparation of coated products with reduced dust emission from aggregate and binder which are introduced into a drum which plays the part of both dryer and coater. This drum, which is of cylindrical or frusto-conical shape, is rotated about its longitudinal axis and receives continuously at one of its ends aggregate or a mixture of aggregate and powdery matter or a mixture of aggregate with or without the addition of powdery matter, and of binder.

In the case where the drum is supplied with aggregate this is generally cold and moist and in certain cases re-moistening of the aggregate is carried out before its entry into the drum. In these known methods the addition of binder is effected either at the inlet to the dryer and coater drum or in a zone of the drum close to the inlet and bringing about mixing of the aggregate with the binder, while the aggregate still contains all its moisture content and is at a rather low temperature. Similarly in the case where the mixture of aggregate with or without the addition of powdery matter and of binder is effected prior to the introduction of the aggregate into the drum, binder, for example, molten bitumen, comes into contact with a material which is cold and moist.

This manner of operating in which the addition of binder takes place prior to any drying of the aggregate has the advantage of binding the fine particles of aggregate before they have been able to be placed in suspension in the gases in circulation in the drum, which accordingly reduces the emission of dust into the outlet gases from the dryer and coater drum.

This manner of operating has, however, the disadvantage of putting the binder which is at high temperature in contact with an aggregate at ambient temperature or at a slightly higher temperature. That causes coagulation of the binder on the granules of aggregate which is detrimental to good distribution of the binder. The aggregate-binder area of contact is not a maximum and there is emission of dust by the particles not covered. the efficacy of this technique as to the reduction of the emission of dust and to the quality of the coated matter is therefore limited.

On the other hand, the addition of the binder into a zone adjoining the inlet to the drum has the disadvantage of introduction of the binder into a zone adjoining the flame of the burner which is generally introduced through the inlet end of the drum, the binder being also exposed to radiation from, and to contact with, the flame and gases at very high temperature, which creates a risk of causing alteration of its properties. On the other hand because the aggregate is kept cold and moist before the addition of the binder, it has not been able to release water vapor, the presence of which in the mixing zone might play a moderating part in the oxidizing effect of the burner.

For all these reasons the methods of coating in a dryer-coater drum with reduced dust emission do not operate under optimum conditions for good spreading of the binder over the particles of the aggregate.

Methods and devices for coating are also known, in which the introduction of the binder is effected in a zone remote from the inlet of the aggregate to the drum and in which the circulation of the hot gases is effected in conterflow to the circulation of the aggregate, the burner being arranged at the outlet end of the dryer-coater drum. These methods assume, however, the employment of a water-binder mixture with a relatively high water content, which is not favorable to the efficiency of the operation since this water must be eliminated by evaporation in the dryer-coater drum.

Finally the methods and devices at present known do not achieve good incorporation of powdery matter with the aggregate before the introduction of the binder, which creates a risk of causing the formation of conglomerates of powdery matter and binder, resulting in a lack of homogeneity in the final product. The powdery matter constituted by particles smaller than approximately 80 $\mu$ is necessary in quite definite proportions in coated products in order to impart sufficient cohesion to these coated products, the properties of the highway surfacing achieved with coated products being optimum for a certain content of powdery matter. The standards in force in certain countries moreover provide for the contents of fine-grain materials. Thus to aggregates which may already contain a certain proportion of powdery matter one may be led to add fine sand, cement or lime, for example. The addition of powdery matter is effected generally on the means of bringing the aggregate to the drum, which introduces into this drum non-homogenized masses of aggregate and powdery matter.

SUMMARY OF THE INVENTION

It is an object of the invention to provide a device for the preparation of materials from aggregate, powdery matter and liquid, comprising a platform, a cylindrical mixer drum having an inlet end and an outlet end, means mounting said drum for rotation about its longitudinal axis on said platform, means for driving said drum in rotation, means for feeding aggregate and powdery matter to said inlet end of said drum, a fixed chamber for discharge of material and in communication with said outlet end of said drum, means for supplying liquid to said drum, said drum being arranged on said platform with said inlet end at a level higher than the level of said outlet end to promote circulation of the products in said drum, said drum comprising in succession in the direction of flow of the products therethrough:

a first zone for introduction of aggregate and powdery matter supplied by said feeding means and in which blades projecting inwardly of said drum are arranged in a spiral on the inner surface of the wall of said drum, a second zone for homogenization of the mixture of aggregate and powdery matter, and in which devices for lifting the aggregate and powdery matter are provided on the inner surface of the wall of said drum, the transverse section of said lifting devices taken in a plane perpendicular to the axis of said drum is variable along said second zone such that the capability of retention of said lifting devices increases in the direction of advance of the products, said capability of retention being low at the inlet to said second zone, a third zone for mixing the products, said binder supplying means discharging at the inlet of said third zone, the surface of the inner wall of said drum being provided in said third zone with lifting devices, the transverse section of which is identical with the transverse section of said lifting devices at the outlet of said second zone, said lifting devices having a high capability of retention such that the products form a substantially continuous curtain across the whole transverse section of said drum.

There is thus provided a device which achieves the incorporation of the binder with the aggregate and with the powdery matter, whereas these are preheated, predried and mixed, so that coating is carried out under satisfactory conditions, the residual moisture content of the aggregate enabling coating with low dust emission. The device also enables introduction of the binder into a zone isolated from the burner flame.

The practice is known of employing on roadworks coating plants, which are intended for the manufacture of bituminous concretes or coated materials having a base of gravel and bitumen, for the manufacture of hydraulic concretes employed to constitute the underlayer of the road or for the construction of auxiliary works.

In the case of a conventional plant comprising a dryer and a mixer it is necessary to disconnect the dryer from the mixer in order to introduce into the mixer, by handling means which must be provided specially, the aggregate consisting of gravel or sand and the cement and/or lime. It is likewise necessary to provide a device for supplying water and distributing it at the inlet to the mixer.

The known mixer for coated materials which is of the type having parallel shafts and arms does not allow its use with aggregates of a screen higher than a certain limit which may be set approximately at 40 mm because of the small gap existing between the arms and the body of the mixer.

With a device in accordance with the invention, where the drum is both a dryer and mixer, it is possible to change from the hot manufacture of coated materials to the cold manufacture of hydraulic concretes by feeding the drum with aggregate and cement, employing the means proper to the addition of powdery matter for incorporating the cement or the lime without having to modify the means for feeding the drum. It is simply necessary to provide a device for feeding water and for proportioning the water connected either to a sprinkler device or to the device for supplying binder.

In any case the means for supplying water to the drum discharges at the beginning of the third zone of the drum.

The burner is not used during the preparation of concrete as well, of course, as the device for exhaust of the hot gases circulating in the drum during the hot manufacture of coated materials.

One advantage of the device in accordance with the invention in its application to the preparation of hydraulic concretes is that it enables aggregates of any screen size to be handled, the stirring being carried out by lifting devices arranged inside the drum.

Another advantage of the device in accordance with the invention in this application is that it achieves in the second zone good homogenization of the aggregate-cement mixture before the introduction of the water, which has the effect of avoiding poor bonding of the aggregate with the cement and defects in homogeneity of the concrete produced. For the same reasons it is possible to employ a device in accordance with the invention equally well for the cold manufacture of coated materials from aggregate, powdery matter and binder in liquid form whatever the screen size of the aggregate and with efficient homogenization of the different grain sizes of aggregate and powdery matter before the addition of the liquid binder.

It is another object of the invention to provide a device for the preparation of coated products from aggregte, powdery matter and binder, comprising a platform, a cylindrical dryer and mixer drum having an inlet end and an outlet end, means mounting said drum for rotation about its longitudinal axis on said platform, means for driving said drum in rotation, means for continuously feeding aggregate and powdery matter to said inlet end of said drum, a burner projecting into said inlet end of said drum, a fixed chamber for discharge of coated product and for exhaust of the gases in circulation in the drum, said fixed chamber being in communication with said outlet end of said drum, means for supplying binder to said drum, said drum being arranged so that said inlet end is at a level higher than the level of said outlet end to promote the circulation of the products in said drum, said drum comprising in succession in the direction of flow of the products therethrough from said inlet end:

a first zone for introduction of aggregate and powdery matter supplied by said feeding means, and in which blades projecting inwardly of the drum are arranged in a spiral on the inner surface of the wall of said drum, a second zone for preheating and predrying of the aggregate and homogenization of the mixture of aggregate and powdery mater, and in which devices for lifting the aggregate and powdery matter are provided on the inner surface of said drum, the transverse section of said lifting devices taken in a plane perpendicular to the axis of said drum is variable along said second zone such that the capability of retention of said lifting devices increases in the direction of advance of the products, said capability of retention being low at the inlet to said second zone, a third zone for drying, mixing and heating the products, said binder supplying means discharging at the inlet of said third zone, the inner surface of the wall of said drum being provided in said third zone with lifting devices, the transverse section of which is identical with the transverse section of said lifting devices at the outlet of said second zone, said lifting devices having a high capability of retention such that the products form a substantially continuous curtain across the whole transverse section of said drum.

BRIEF DESCRIPTION OF THE DRAWINGS

An embodiment of a device in accodance with the invention and its use both in the hot manufacture of coated materials as well as in the cold manufacture of coated materials will now be described, by way of example only, with reference to the accompanying drawings.

In the drawings.

DETAILED DESCRIPTION

Figure 1:
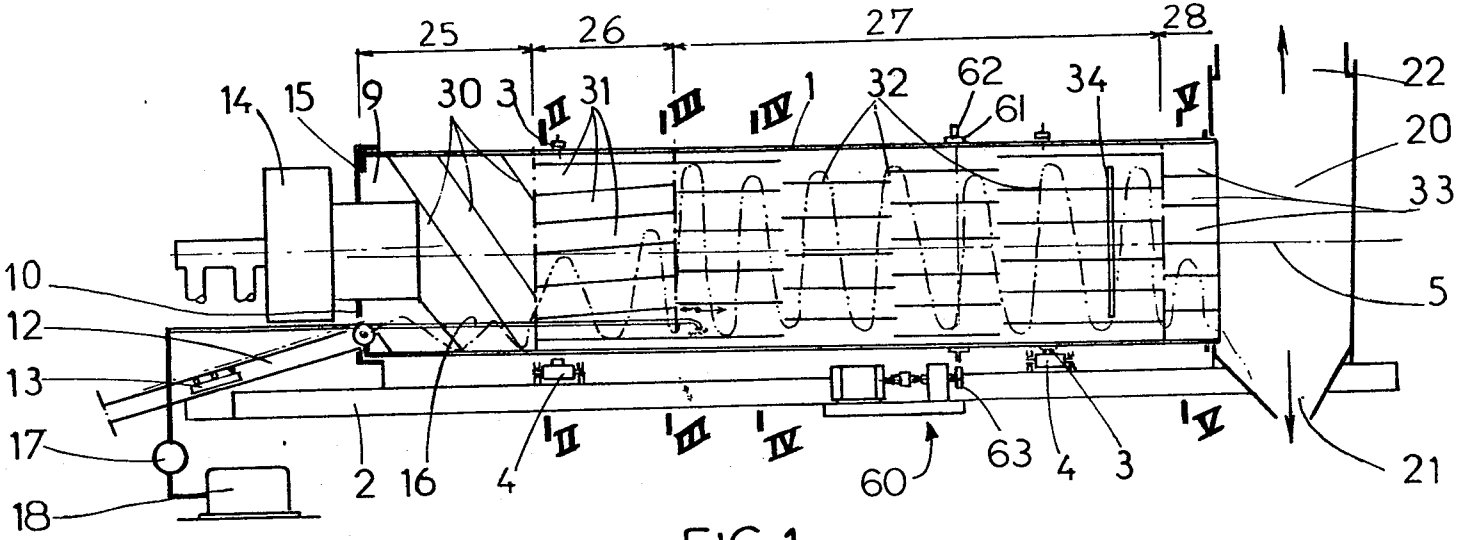
FIG. 1 is a side elevation of an embodiment of a device in accordance with the invention with the drum sectioned along the vertical plane passing through its axis, showing the devices for carrying along and lifting the products inside the drum.
Figure 5:
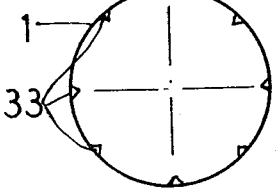
FIGS. 2 to 5 are sections through the drum perpendicular to the axis of the drum and taken on the lines II—II, III—III, IV—IV and V—V respectively in FIG. 1.

In FIG. 1 there is seen a drum 1 supported on a platform 2 by means of crowns 3 resting on roller devices 4. The drum can thus rotate about its longitudinal axis 5. The drum is driven in rotation by a device 60 comprising a toothed crown 61, chain 62 and pinion 63. The front inlet end 9 of the drum is partially open to receive the end of a belt conveyor 12 bringing the aggregate and powdery matter continuously to the inlet of the drum. A fuel-oil burner 14 projects into the drum through the end 9. To this burner 14 is attached a cheek 15 which partially blocks the front inlet end opening of the drum. Clearance between the cheek 15 and the drum 1 and between the drum and the conveyor 12 are provided to enable rotation of the drum 1. A pipe 16 for sprinkling the aggregate with binder also enters the drum through the front end 9, the position of the sprinkler end of the pipe 16 in the furnace being adjustable.

The pipe 16 is connected to a feed circuit comprising a binder distribution pump 17 which supplies binder to the pipe 16 from a receiver 18 for conditioning the binder, and which is kept at the melting point of the binder. The output from the pump 17, proportioned to its speed of rotation, is controlled in dependence on the indications of a gravimetric detector which continuously measures the amount of aggregate brought to the drum, which enables the introduction of binder to be proportioned as a function of the flow of the aggregate feed.

Figure 7:
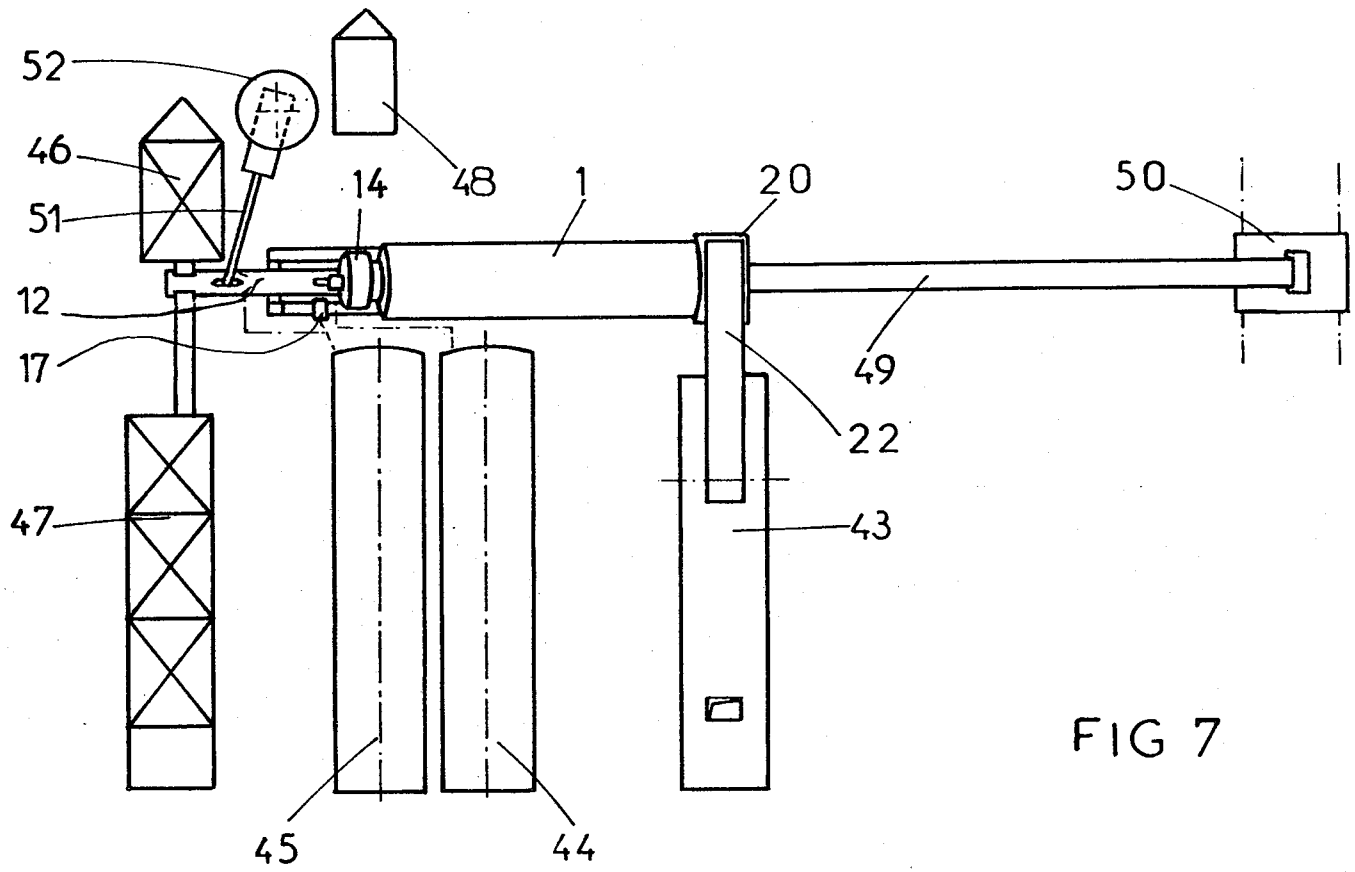
FIG. 7 shows the general layout of a coating site employing a device in accordance with the invention.

The gravimetric detector is associated with the conveyor 12 at a portion upstream of a device 51 (FIG. 7) for supplying the powdery matter to the conveyor.

The device for the supply of powdery matter includes in addition to the means 51, a reserve 52 of powdery matter and a device for continuous proportioning by weight, which delivers amounts of powdery matter in proportion to the amounts of aggregate delivered to the drum, as measured by the gravimetric detector associated with the conveyor 12. A device for measuring the water content of the products introduced into the drum, arranged in the vicinity of the conveyor 12 likewise enables weight corrections to be made to the measurement of the amounts of aggregate delivered to the drum.

The platform 2 is arranged on supports which are adjustable for height (not shown), which enable the platform to be inclined so that the inlet end is at a higher level than the outlet end from which coated products are removed. A slight inclination of the drum, adjustable as a function of the products being treated, promotes the advance of the products inside the drum from the inlet end to the outlet end where the drum discharges through its end 10 into a fixed chamber 20 forming at its lower portion a hopper 21 through which the coated products flow to a device for discharging these products. The upper portion of the fixed chamber 20 is connected to a flue 22 for exhaust of the gases passing through the drum; this flue 22 may be connected to a device for purifying these gases for escape to atmosphere.

Reference will now be made to FIGS. 1 to 5 to describe the various treatment zones of the dryer and coater drum from its inlet end up to the outlet of the products into the chamber 20. The first zone or zone of introduction of the aggregate into which the burner 14 and the end of the conveyor 12 extend enables rapid introduction of the aggregate and powdery matter into the interior of the drum while keeping the aggregate against the inner wall of the drum in order to avoid direct contact between the flame of the burner and the aggregate entering the drum.

The falling of material through the flame in fact may adversely affect its satisfactory development and in that way even the quality of the combustion. Again, direct flame-aggregate contact creates the risk of causing bursting of the material and alteration in the grain size of the product by manufacture of fine elements which are difficult to collect. In order to introduce the material rapidly into the drum and to avoid its falling through the flame, the introduction zone 25 comprises paddles 30 for guidance of the material, which paddles project inside the drum and extend in a spiral on the inner face of the drum. The pitch of the spiral is chosen to be coarse enough so that the material is introduced rapidly into the next zone of the drum. The paddles 30 play only the part of guiding and carrying the aggregate forms towards the next zone, the aggregate remaining against the inner wall of the drum. In FIG. 1 a wavy dash-dot line shows diagrammatically the advance of the products inside the drum from the inlet conveyor 12 to the outlet hopper 21.

Upon leaving the zone 25, the aggregate enters a preheating, predrying and homogenization zone 26 where the inner wall of the drum is lined with devices 31 for lifting up the aggregate. The profile of these lifting devices, which may be seen in FIGS. 2 and 3, includes a concavity which enables lifting the matter to a certain height during rotation of the drum.

The curvature of the profile of the lifting devices 31 varies continuously from the inlet to the zone 26 (FIG. 2) to the outlet of this zone (FIG. 3), so that the matter is lifted during the rotation of the drum to a greater or lesser degree. At the beginning of the zone the curvature of the profile of the lifting devices is very small so that capability of retention of the lifting devices during the course of rotation of the drum and the lifting effect are in turn very small and the area of the curtain of matter which falls back into the section of the drum is practically nil. The curvature of the lifting devices at the outlet from the zone 26 is on the contrary such that lifting of the matter is effected to the highest point of the drum during the course of its rotation, the curtain of matter, which falls back like rain into the bottom of the drum, then occupies substantially the whole section of the drum.

Figure 4:
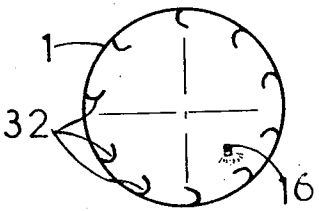
Figure 3:
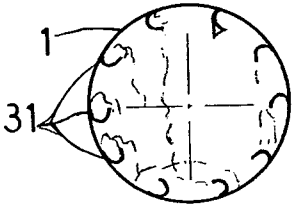
Figure 2:
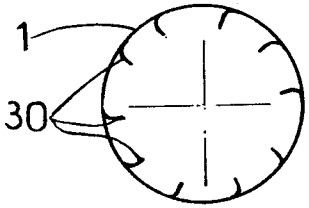

A zone 27 for drying, mixing and heating the products lies next to the preheating and predrying zone 26 and is the zone where mixing of the binder and the aggregate takes place, the discharge end of the pipe 16 being positioned at the beginning of this zone. In the zone 27 the inner wall of the drum is lined with lifting devices 32 (FIG. 4). The curvature of the profile of these lifting devices is the same as that of the lifting devices at the outlet of the zone 26, with the result that the materials are lifted up to the highest point of the drum during its rotation and the curtain of material occupies substantially the whole section of the drum during passage through this zone 27. An anti-dust screen 34 is arranged at the outlet from the zone 27 in order to collect dust which the gases in circulation in the drum may still contain at this level in the case of materials which are highly loaded with fine elements. A large proportion of the dust, however, is caught by the continuous curtain of matter which occupies the section of the drum.

The last zone 28 of the drum is a zone for homogenization of the coated products and which also effects their discharge through the outlet end 10 of the drum into the fixed chamber 20 for discharge of the coated products. In this zone the inner wall of the drum is lined with ribs 33 constituted sections welded on to the inner wall of the drum. The inner wall of the drum may alternatively be smooth in this zone.

An operation of hot coating will now be described, such as takes place in the device which has been described above.

After the addition by the device 51 of proportioned amounts of powdery matter of a grain size smaller than 80 $\mu$ which is intended to ensure the overall content of fine elements in the aggregate on the conveyor 12 as required by the standards, the cold and moist aggregate, proceeding from a group of proportioner hoppers which ensures a well defined granulometric composition, is introduced by the conveyor 12 into the inlet of the introduction zone 25. At this point, the spiral paddles 30 take charge of it and guide the aggregate along to the outlet of the introduction zone so that it remains against the inner wall of the drum without coming into contact with the flame of the burner 14 which occupies a central position in the drum. During its passage through the introduction zone, the aggregate, arranged in a compact layer against the inner wall of the drum, does not undergo any drying or substantially any reheating or any mixing with the powdery matter which has been placed on the conveyor 12, with the result that it arrives in the next zone 26, which is devoted to its predrying and preheating, in the state in which it was at the inlet to the drum. In the zone 26 the lifting devices 31 of increasing capability of retention progressively bring the aggregate to form a continuous curtain occupying the whole of the interior section of the drum. At the inlet to the zone 26 the area of the curtain of material is practically nil but at the outlet of the zone 26 the material occupies the whole section of the drum. The particular shape of the lifting devices and their concavity which is variable along the zone 26 enables the formation of a central region which is devoid of material over the greater portion of the zone 26 in order to enable development of the flame of the burner which has a central position in the drum. This flame forms a current of hot gases which passes through the drum and exits through the exhaust flue 22 connected to the fixed chamber 20 by way of an extraction fan (not shown) arranged in the flue 22.

The stirring of the aggregate and powdery matter in the zone 26 causes homogenization of the aggregate-powder mixture which is favorable to homogeneous coating of the products.

The aggregate being raised progressively by the lifting devices in the zone 26 undergoes reheating and partial drying, the length of the zone 26 determining the final temperature and the residual moisture content of the aggregate leaving the zone. Prolonged preheating must be avoided as it creates a risk of causing too forced dehydration of the fine particles of aggregate resulting in their suspension in the gases of combustion. The continuous curtain of matter formed at the outlet of the zone 26 has the advantage of isolating the zone 27, where the incorporation of the binder into the aggregate takes place, from the flame by forming an anti-radiation screen and preventing the combustion from being propagated as far as the zone 27 where the binder is introduced. On the other hand the temperature of the gases at the outlet of the zone 27, where the introduction of the binder takes place, is considerably lowered because the aggregate has collected a portion of the heat from the gases by predrying.

Finally the partial drying of th aggregate produces a small amount of steam which reduces the oxidizing power of the gases of combustion. On leaving the zone 26, therefore, the aggregate is heated to an average temperature of, for example, 80° C and is partially dried, which constitutes conditions favorable to good spreading of the bitumen over this aggregate. In the drying, mixing and heating zone 27 which is next entered by the mixture of powdery matter and aggregate, the lifing devices create a continuous curtain of matter across the section of the drum. The sprinkler pipe 16, the opening of which is directed downwards, projects hot liquid binder on to the mixture of powdery matter and aggregate when it is in a lower portion of the drum at the inlet of the zone 27. The aggregate covered with binder is then taken up by the lifting devices to fall like rain into the bottom of the drum. The hot bitumen covering the aggregate, which still contains a certain proportion of water, causes the evaporation of this water which, escaping in the form of steam, causes the formation of a cloud of bitumen which distributes itself over the materials during the course of their fall in the drum and catches the fine particles put into suspension in the gases in the zone 26. The curtain of material is sufficiently continuous across the drum for the area of exchange between the products and the gases of combustion to be considerable. This enables also the capture of dust by the already coated particles. Finally, the successive lifting and falling back of the materials causes mixing in the zone 27 which enables coating. Thus, coating of the aggregate is achieved with prior mixing of the cold moist aggregate and the binder in a special zone preceding the zone for drying and reheating the coated materials.

The position of the end of the pipe 16 in the zone 27 is adjustable as a function of the conditions of use of the device. In positioning the end of the pipe 16 account may be taken of the following points:

injection too near the burner causes distillation of the more volatile elements in the bitumen which is indicated by the appearance of blue smoke at the chimney of the plant and by poor quality of the coated products, injection too far from the burner is characterized by too great an escape of dust.

Hence, by observing the gases expelled into the atmosphere the position of the end of pipe 16 may be adjusted. In order to adjust the position of the pipe automatically the displacements of a mechanical device adjusting the position of the pipe in the drum may be controlled in dependence on the indications of an opacimeter arranged in the flue 22 for the hot gases. Thus, the position of the point of application of the binder to the aggregate may be adjusted automatically as a function of the coloration and dust content of the gases expelled.

The coated products leaving the zone 27 enter a zone 28 where final homogenization of the mixture is effected. This zone, which is a zone of low speed of advance, causes reheating and regular discharge of the coated products. On leaving the sone 28 the gases and the coated particles enter the fixed chamber 20 which, apart from its role of discharging the coated products and exhausting the gases of combustion, plays a certain part in the extraction of dust from the gases. That is, the gases expand and change direction in this fixed chamber, which causes separation of some of the heavier particles in suspension in the gases, these particles being recovered by sticking to the surface of the fixed chamber 20 or by falling into the material outlet channel.

An operation will now be described, of the preparation of hydraulic concrete from aggregate (sand, gravel) and cement in the above described device.

During this operation the burner does not operate and the gas exhaust fan located in the flue 22 is stopped.

The pipe 16 is connected to a device for feeding water, having means for controlling the rate of supply of water, consisting of a pump with its flow controlled in dependence on the indications of the gravimetric detector connected to the conveyor 12, the output of which is corrected by the indications of the detector for detecting the moisture in the aggregate.

The conveyor 12 introduces into the drum the aggregate consisting of gravel and sand, delivered from proportioner hoppers, and cement which is supplied to the conveyor by the device 51 in amounts proportioned at a function of the indications of the gravimetric detector.

The introduction zone 25 performs practically no mixing of the aggregate and cement. On entering the homogenization zone 26 the products are at first lifted up very slightly, which avoids putting the cement into suspension, which could prejudice its mixture with the aggregate, but brings about partial sticking of the cement to the slightly moist particles of aggregate. This sticking having been achieved, the progressive lifting up of the aggregate-cement mixture leads to a homogenization of the mixture which is the more thorough the greater the length of the zone 26.

At the outlet of the zone 26 the dry thoroughly homogenized aggregate-cement mixture enters the mixing zone 27 at the beginning of which the pipe 16 discharges, ensuring the proportioned introduction of water into the mixture. The lifting up of the mixture causes the formation of a curtain across the whole area of the drum, which enables all the particles of cement to be caught which may be in suspension in the drum and carries out effective mixing of the concrete. By the lifting up of the concrete formed in a bottom portion of the drum following sprinkling with water and the falling back of this concrete across the whole area of the drum, mixing is achieved which is applicable to any type of concrete whatever the screen of the gravel in the aggregate end which is quite as effective as the mixing achieved in conventional devices for the preparation of hydraulic concrete.

At the outlet from the zone 27 the concrete enters the zone 28 where final homogenization of the concrete is effected. The concrete is then poured into the fixed chamber 20 which carries out its discharge through the material outlet channel.

The preparation of cold bituminous coated products can be carried out in the above described device in a similar fashion, the proportioned sprinkling of water being replaced by proportioned sprinkling of a bituminous emulsion or cut-back on to the thoroughly homogenized aggregate-powder mixture which on leaving the homogenization zone 26 passes into the mixing zone 27.

Different adjustments of the plant are provided in order to enable constant quality of the coated product or the concrete to be obtained whatever the condition of the original aggregate and the hourly production required. Thus, proportioning of the aggregate per granulometric section is ensured by proportioner hoppers equipped with extractor belts, before transport by the belt conveyor 12 which brings the aggregate to the drum. This proportioning may be either by volume or by weight. The proportioning of the bitumen is ensured by the pump 17, the speed of rotation of which is controlled in dependence on the weight indication from the detector connected to the conveyor 12. At this level, a correction is necessary to take account of the weight of the water contained in the material. The quantity of powdery matter added to the aggregate is likewise proportioned as a function of the indications of the gravimetric detector for the aggregate, provided a correction is again made due to the variable moisture in this aggregate. The heating power of the burner is controlled in continuous operation in dependence on the temperature of the aggregate or on the temperature of the flue gases or on a combination of the two. The burner may thus react to an increase demanded in the flow or to a variation in the moisture in the aggregate.

If it is required to let the hourly production at the coating station vary, it is sufficient to let the general flow from the proportioner hoppers vary while preserving the proportions between the various granulometric constituents. The flow of binder and of powdery matter will be modified automatically due to the change in the indication of the gravimetric detector at the time of the passing of the aggregate along the conveyor device 12. Thus a constant ratio may be ensured between the aggregate, the powdery matter and the binder for different hourly tonnages.

Figure 6:
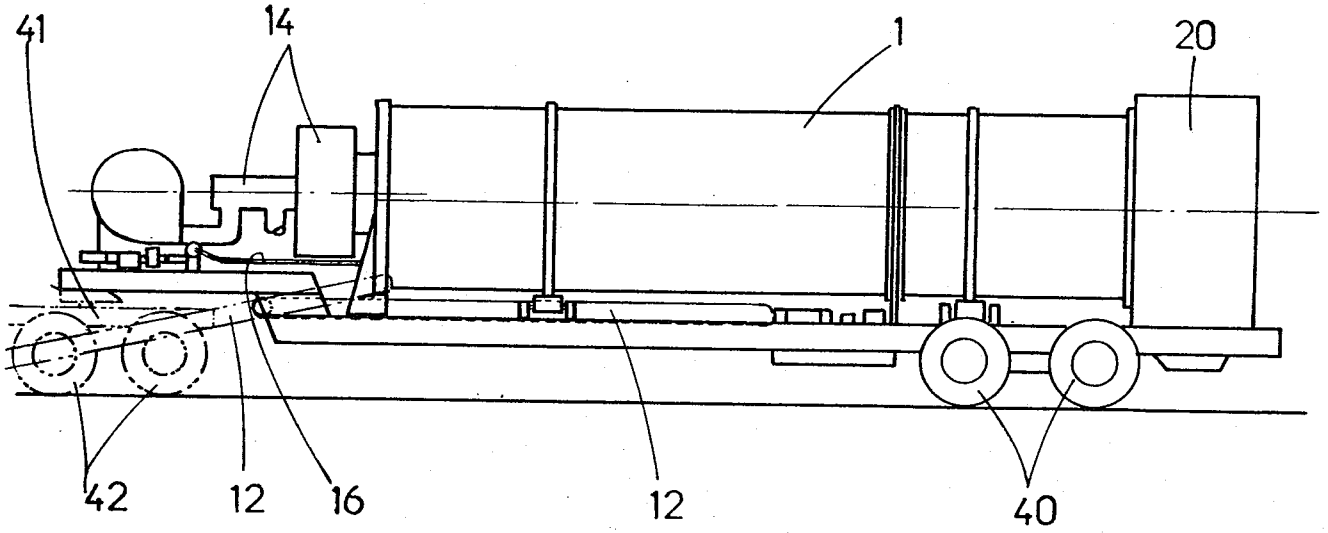
FIG. 6 shows in side elevation a device in accordance with the invention on a road-trailer.

In FIG. 6 is seen a dryer-mixer drum 1 arranged on the platform 2 of a road semi-trailer resting on the ground by way of a wheel train 40. The portion of the platform 2 located above the tractor part 41, shown in dash-dot outline with its rear wheel train 42, carries the burner 14 and its fuel feed means as well as the pump for feeding bitumen to the pipe 16. In the position for transport, the tractor element 41 and the platform 2 are joined together and the belt conveyor 12 occupies the position shown in full line in FIG. 6 underneath the dryer-mixer drum. In the position for service on site the plaform 2 is uncoupled from the tractor device 41 and its front portion is set to rest on a prop or on a supporting block. The belt conveyor 12 is then brought into its working position shown in dash-dot lines in FIG. 6. The device in accordance with the invention is then ready for use in a layout of the type shown in FIG. 7.

In this Figure is seen the drum 1 and means for feeding it with aggregate, consisting of the belt conveyor 12 in its working position located to be fed with aggregate proportioned by the extractor conveyors from the proportioning hoppers 46 and 47. The device 51 for proportioning and feeding powdery matter to the conveyor 12 is connected to the device 52 for storage of the powdery matter.

The pump 17 for feeding liquid bitumen to the pipe 16 is connected to a bitumen tank 45. The injection device of the burner 14 is connected to a fuel tank 44. Exhaust of the burnt gases circulating through the drum to atmosphere is effected by way of the flue 22 and a dust-extractor 43 which may be necessary in order to comply with the regulations even though the gases expelled by the device are practically free from dust. The coated products are picked up at the bottom of the hopper 21 on the fixed chamber 20 by a conveyor 49 which brings these coated products into a storage hopper 50. The hopper 50 lies above a track for trucks which transport the coated products. The entire operation can be controlled from a hut 48.

Figure 8:
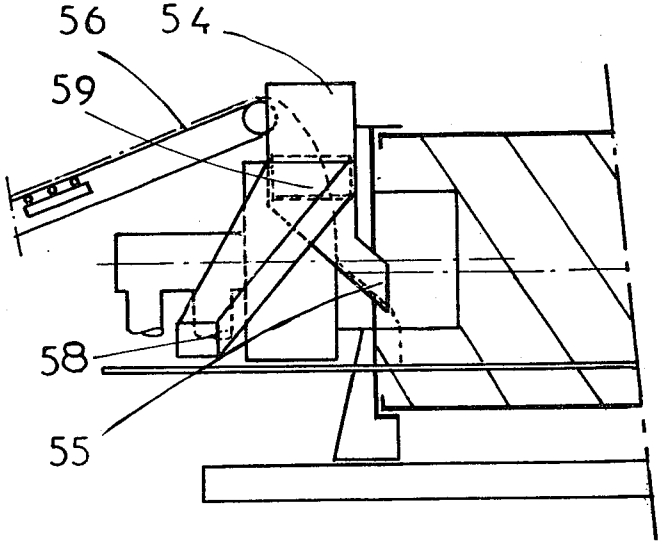

In FIG. 8 there is shown a modification of the system for feeding the drum with aggregate and powdery matter, enabling calibration of the proportioner hoppers to be carried out.

A hopper 54 the bottom portion 55 of which projects through the end of the drum is fed with aggregate and powdery matter by a conveyor 56. This hopper includes a channel directed towards the outside of the drum and a bypass shutter 59 which is operable to cause the products to flow either through the channel 55 for feeding the drum or through the channel 58 for sampling relatively large amounts of material, for example, 5 tons intended for filling a truck to take the sample to a weighing device for calibration of the proportioner hoppers.

Figure 9:
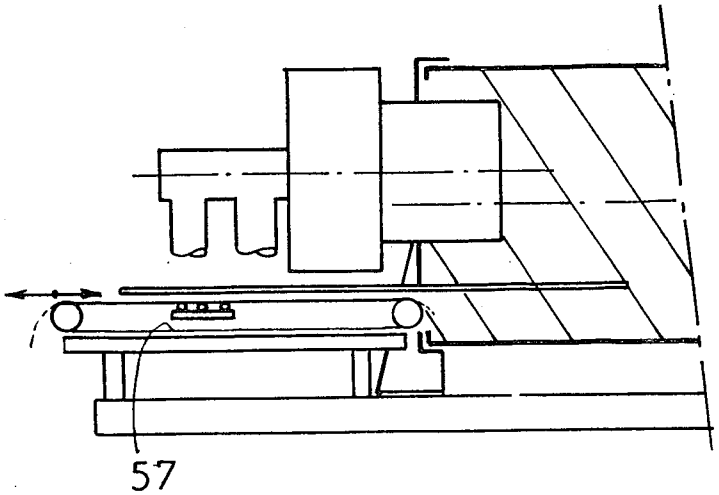
FIGS. 8 and 9 show two modifications of the device of FIG. 1.

In FIG. 9 there is shown another modification of the system for feeding the drum enabling calibration of the proportioner hoppers to be carried out.

A conveyor 57 having two directions of operation enters the end of the drum and can be made to run in one direction to take the aggregate-powder mixture into the drum and in the other direction to take the mixture to a truck for taking the sample to the weighing device.

The invention is not intended to be restricted to the embodiment which has just been described; on the contrary it comprises variants and the employment of equivalent means which may be visualized without thereby departing from the scope of the invention. Thus the shape and dimensions of the paddles for introduction of the aggregate or the lifting devices may be different from those which have been illustrated.

Instead of lifting devices with concave sections the curvature of which varies continuously in the second zone located after the introduction zone, as in the embodiment which has just been described, lifting devices may be employed whose curvature varies discontinuously so that the capability of retention of the lifting devices increases discontinuously in the direction of advance of the products along the second zone of the drum. Alternatively, lifting devices may be provided whose successive transverse sections are homothetic with one another, the size of these sections increasing in the direction of advance of the products along the second zone of the drum and the size being small at the beginning of the zone so that the lifting devices have a low capability of retention. The size of the transverse section of the lifting devices is considerable and corresponds with a high capability of retention at the outlet of the second zone of the drum and in the third zone of the drum to ensure mixing.

Types of homothetic sections which have been found to be satisfactory in a drum of the above described device are L-shapes and sections in the shape of an inverted F as well as other sections consisting of a succession of broken lines and hence not consisting of a curved line.

Similarly, it is possible to conceive of a succession of zones at the outlet of the drum, different from that which has just been described.

The dryer and coater drum illustrated in FIG. 1 comprises an outlet zone 28 interposed between the mixing, drying and heating zone 27 and the fixed chamber 20. In a modification, the zone 28 is omitted, products from the mixing, drying and reheating zone 27 being supplied directly to the fixed chamber 20. The device for introduction of binder has been shown in the form of a pipe 16 but other methods of introduction may be used such, for example, as a row of sprinklers or an injector.

Finally, the above described device is not only suitable for the preparation of materials for highway construction but is also capable of use in numerous other domains such as the construction of sports fields, industrial floors, aerodrome runways and the like.

What is claimed is:

1. A device for the preparation of coated products from aggregate, powdery matter and binder, comprising a platform, a cylindrical dryer and mixer drum having an inlet end and an outlet end, means mounting said drum for rotation about its longitudinal axis on said platform, means for driving said drum in rotation, means for continuously feeding aggregate and powdery matter to said inlet end of said drum, a burner projecting into said inlet end of said drum, a fixed chamber for discharge of coated product and for exhaust of the gases in circulation in the drum, said fixed chamber being in communication with said outlet end of said drum, means for supplying binder to said drum, said drum being arranged so that said inlet end is at a level higher than the level of said outlet end to promote the circulation of the products in said drum, said drum comprising in succession in the direction of flow of the products therethrough from said inlet end;

a first zone for introduction of aggregate and powdery matter supplied by said feeding means, and including blades projecting inwardly of the drum arranged in a spiral on the inner surface of the wall of said drum, a second zone for preheating and predrying of the aggregate and homogenization of the mixture of aggregate and powdery matter, and including means for lifting the aggregate and powdery matter provided on the inner surface of said drum, the transverse section of said lifting means taken in a plane perpendicular to the axis of said drum being variable along said second zone such that the capability of retention of said lifting means increases in the direction of advance of the products, said capability of retention being low at the inlet to said second zone, such that relatively little material will be lifted and dropped at said inlet to said second zone and thus will not interfere with the flame from the burner, third zone for drying, mixing and heating the products, said binder supplying means discharging at the inlet of said third zone, the inner surface of the wall of said drum being provided in said third zone with further lifting means, the transverse section of which is identical with the transverse section of said lifting means at the outlet of said second zone, said further lifting means having a high capability of retention such that the products form a substantially continuous curtain across the whole transverse section of said drum at the inlet of the third zone to isolate the third zone and the binder supplying means from the second zone.

2. A device as claimed in claim 1, wherein the outlet of said third zone opens directly into said fixed chamber for discharge of the coated products.

3. A device as claimed in claim 1, including a further mixing and reheating zone providing relatively slow advance of the coated products arranged between said third zone and said fixed chamber for discharge of the coated products.

4. A device as claimed in claim 1, wherein the transverse section of the lifting means in said second zone is curved-in, the curvature increasing in the direction of advance of the products and being relatively slight at the inlet to said second zone.

5. A device as claimed in claim 1, wherein successive transverse sections through said lifting means in said second zone, taken along the zone in the direction of advance of the products are homothetic with one another and of increasing size, the size being relatively small at the inlet to said second zone.

6. A device as claimed in claim 1, including a gravimetric detector associated with said means for feeding aggregate to said drum, wherein said means for supplying binder to said drum includes a pump which is controlled in dependence on the output of said gravimetric detector.

7. A device as claimed in claim 6, including means for continuously proportioning by weight the powdery matter as a function of the amount of aggregate measured by said gravimetric detector and for supplying the powdery matter to said feeding means.

8. A device for the preparation of materials from aggregate, powdery matter and liquid, comprising a platform, a cylindrical mixer drum having an inlet end and an outlet end, means mounting said drum for rotation about its longitudinal axis on said platform, means for driving said drum in rotation, means for feeding aggregate and powdery matter to said inlet end of said drum, a fixed chamber for discharge of material and in communication with said outlet end of said drum, means for supplying liquid to said drum, said drum being arranged on said platform with said inlet end at a level higher than the level of said outlet end to promote circulation of the products in said drum, said drum comprising in succession in the direction of flow of the products therethrough:

a first zone for introduction of aggregate and powdery matter supplied by said feeding means and including blades projecting inwardly of said drum arranged in a spiral on the inner surface of the wall of said drum, a second zone for homogenization of the mixture of aggregate and powdery matter, and including means for lifting the aggregate and powdery matter provided on the inner surface of the wall of said drum, the transverse section of said lifting means taken in a plane perpendicular to the axis of said drum being variable along said second zone such that the capability of retention of said lifting means increases in the direction of advance of the products, said capability of retention being low at the inlet to said second zone such that relatively little material will be lifted and dropped at said inlet to said second zone, a third zone for mixing the products, said binder supplying means discharging at the inlet of said third zone, the surface of the inner wall of said drum being provided in said third zone with further lifting means, the transverse section of which is identical with the transverse section of said lifting means at the outlet of said second zone, said further lifting means having a high capability of retention such that the products form a substantially continuous curtain across the whole transverse section of said drum at the inlet of the third zone to isolate the third zone and the binder supplying means from the second zone.

9. A device as claimed in claim 8, wherein the outlet of said third zone opens directly into said fixed chamber for discharge of the coated products.

10. A device as claimed in claim 8, including a further mixing zone providing relatively slow advance of the products arranged between said third zone and said fixed chamber.

11. A device as claimed in claim 8, wherein the transverse section of the lifting means in said second zone is curved-in, the curvature increasing in the direction of advance of the products and being relatively slight at the inlet to said second zone.

12. A device as claimed in claim 8, wherein successive transverse sections through said lifting means in said second zone, taken along the zone in the direction of advance of the products are homothetic with one another and of increasing size, the size being relatively small at the inlet to said second zone.

13. A device as claimed in claim 8, including a gravimetric detector associated with said means for feeding aggregate to said drum, wherein said means for supplying binder to said drum includes a pump which is controlled in dependence on the output of said gravimetric detector.

14. A device as claimed in claim 13, including means for continuously proportioning by weight the powdery matter as a function of the amount of aggregate measured by said gravimetric detector and for supplying the powdery matter to said feeding means.

15. A device as claimed in claim 1, wherein said platform is the platform of a road-trailer used for moving said device and said means for feeding said drum with aggregate and powdery matter is a belt conveyor which may be retracted into a housing arranged underneath said drum when it is not in use.

16. A device as claimed in claim 8, wherein said platform is the platform of a road-trailer used for moving said device and said means for feeding said drum with aggregate and powdery matter is a belt conveyor which may be retracted into a housing arranged underneath said drum when it is not in use.

* * * * *